US006084337A

United States Patent [19]

Beardmore

[11] Patent Number: 6,084,337

[45] Date of Patent: Jul. 4, 2000

[54] ELECTRODE STRUCTURES WITH ELECTRICALLY INSULATIVE COMPRESSABLE ANNULAR SUPPORT MEMBER

[75] Inventor: Geoffrey Beardmore, Cheltenham, United Kingdom

[73] Assignee: Smiths Industries Public Limited Company, London, United Kingdom

[21] Appl. No.: 09/118,906

[22] Filed: Jul. 20, 1998

[30] Foreign Application Priority Data

Aug. 7, 1997 [GB] United Kingdom ..... 9716640

[51] Int. Cl.[7] ..... H01K 1/18

[52] U.S. Cl. ..... 313/292; 313/257; 313/258

[58] Field of Search ..... 313/292, 257, 313/258, 268, 281, 283, 284

[56] References Cited

U.S. PATENT DOCUMENTS 4,071,802 1/1978 Yamasaki .

FOREIGN PATENT DOCUMENTS

| | | |
|---|---|---|
| 0383728 | 8/1990 | European Pat. Off. . |
| 29703990 | 5/1997 | Germany . |
| 310066 | 4/1929 | United Kingdom . |
| 400320 | 10/1933 | United Kingdom . |
| 670292 | 4/1952 | United Kingdom . |
| 767446 | 2/1957 | United Kingdom . |
| 1099413 | 1/1968 | United Kingdom . |

*Primary Examiner*—Vip Patel

*Attorney, Agent, or Firm*—Pollock, Vande Sande & Amernick

[57] ABSTRACT

A gas discharge lamp has a tubular envelope containing tubular electrodes at opposite ends. An annular support member of a compressible ceramic fiber is supported in a groove around each electrode and is compressed against the inside surface of the envelope. Movement of the electrodes relative to the envelope is damped by the support member.

17 Claims, 3 Drawing Sheets

ELECTRODE STRUCTURES WITH ELECTRICALLY INSULATIVE COMPRESSABLE ANNULAR SUPPORT MEMBER

BACKGROUND OF THE INVENTION

This invention relates to electrode structures and to lamps including electrode structures.

The electrodes in cold cathode lamps are often in the form of a short tube, which is closed at one end where it is supported by electrical terminals, and is open at its opposite end. The electrodes and their support terminals can be subject to relatively large forces where they are used in high vibration environments. The electrodes and support wires may also be weakened by the filling substances in the lamp tube, such as mercury. This can lead to damage to the electrode structure. Strengthening the electrode support structure does not necessarily help because it can lead to an increase in mass and affect the electrical properties of the electrode or make assembly more difficult.

BRIEF SUMMARY OF THE INVENTION

It is an object of the present invention to provide an improved electrode structure and lamp.

According to one aspect of the present invention there is provided an electrode structure including a generally tubular electrode extending coaxially within an outer tubular envelope and electrically connected with an electrical conductor extending out of the envelope, the electrode structure including a support member of annular section contacting the inner surface of the envelope and the outer surface of the electrode, and the support member being of a electrically-insulative, compressible material arranged to damp movement of the electrode relative to the envelope.

The support member is preferably porous, such as a fibre material, which may be a woven or knitted fibre material, such as an open looped weave fibre material. The support member is preferably of a ceramic material such as silica, alumina or zirconia. The support member may be retained on a surface formation on the outside of the electrode, such as an annular groove around the electrode. The support member may be retained by an adhesive. The support member may be a single annular ring located at the effective centre of gravity of the electrode structure. Alternatively, the electrode structure may include two annular support members spaced apart from one another along the length of the electrode. In another alternative embodiment, the support member is a tubular sleeve extending substantially along the length of the electrode.

The electrode may be provided by a solid cylindrical wall having a plurality of holes formed through its thickness around its surface so as to reduce the mass of the electrode. The holes are preferably circular and have a diameter substantially equal to the thickness of the wall. The holes may be spaced along parallel lines, the ratio of the diameter of the holes to the spacing between the lines being about 0.667. The ratio of the spacing between holes in adjacent lines to the spacing between adjacent holes along a line is preferably about 0.866.

According to another aspect of the present invention there is provided a discharge lamp including an electrode structure according to the above one aspect of the invention.

A discharge lamp and several alternative cold cathode electrode structures for the lamp, according to the present invention, will now be described, by way of example, with reference to the accompanying drawings.

DETAILED DESCRIPTION OF THE PREFERRED EMBODIMENT

Figure 1:
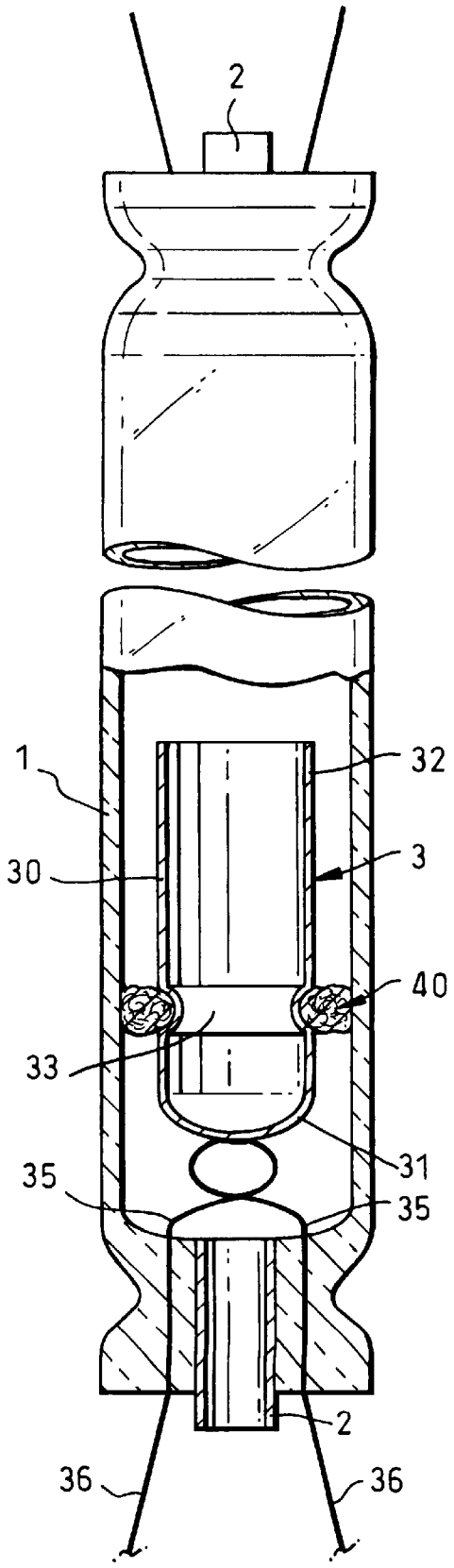
FIG. 1 is a sectional side elevation view of a first form of lamp.

With reference first to FIG. 1, the lamp includes a tubular glass envelope 1 of cylindrical shape and circular section. In the present example, the envelope 1 is shown as extending straight but it could be curved or bent to any conventional shape, such as of serpentine shape. The envelope is evacuated to a reduced pressure and is filled with a discharge gas or gas mixture, in the usual way. A sealable exhaust port 2 opens into each end of the envelope 1 to enable it to be exhausted and filled with the discharge gas. At each end of the envelope 1 there is a cold cathode electrode structure 3 but, since these are identical, only the lower electrode structure will be described.

The electrode structure 3 comprises an electrode 30 in the form of a short metal tube of circular section. Typically, the tube is about 30 mm long, about 7 mm in diameter and with a wall thickness of about 0.3 mm. The electrode 30 is closed at one end 31 and is open at the opposite end 32, the electrode extending coaxially within the envelope 1 with its closed end towards the closed end of the envelope and its open end facing away from the closed end. At a location spaced about one third the way along the electrode 30 from its closed end, the electrode has a necked in surface formation or an annular channel 33 around the outside surface of the electrode. The electrode structure 3 also includes a terminal element formed by two metal wires 35, each bent into an S-shape within the envelope and welded to the closed end 31 of the electrode 30. The ends 36 of the wires 35 extend through and are sealed into the closed end of the envelope 1. The terminal element 35 provides a major part of the mechanical support for the electrode 30 within the envelope 1 and also provides electrical connection to the electrode through the wall of the envelope.

The electrode structure 30 is completed by an annular support member 40 located in the annular channel 33 and engaging the inside surface of the envelope 1 and the outside surface of the electrode 30. The support member 40 is electrically insulative and compressible and may be of various different kinds. In the arrangement shown in FIG. 1, the support member 40 is an annular ring of ceramic fibre such as silica, alumina or zirconia, which is woven or knitted and porous. Alternatively, the fibre may be of an open looped weave so that there are no loose fibres and the looped structure imparts a resilience to the component similar to that of a nylon scouring pad. Alternatively, a non-woven mat construction might be possible if the fibres are bonded together, such as by using an inorganic cement. The thickness of the fibre ring 40 is such that it is a close, compressed fit in the annular gap between the envelope 1 and the electrode 30, contacting both the inside of the envelope and the outside of the electrode. The ring 40 is preferably held in position solely by the mechanical engagement in the channel 33 and by friction with the inside of the envelope 1. Alternatively, an inorganic cement could be used to bond the ring 40 to one or both of the envelope 1 and the electrode 30.

The fibre ring 40 provides friction damping of movement of the electrode 30 under vibration conditions and also soft snubbing under shock. Damping is provided in all planes and the ring 40 conforms to the local geometry during assembly and over the operating life of the lamp. The fibre ring 40 has a very low mass that does not add significantly to the total mass of the electrode assembly 3. The ceramic fibre can be inert and unaffected by the temperatures during operation and assembly; the porous nature of the ring 40 means that it has no substantial effect on gas flow around the electrode assembly 3 during evacuation, filling or operation. Although the dielectric constant of the ceramic in the ring 40 is greater than that of the glass forming the envelope 1, this has no significant effect on the operation of the electrode 30 because the fibre volume in a typical woven structure is only about 5% of the overall volume, leading to a very small or negligible increase in effective dielectric constant. The fibre ring 40 is relatively easy to manufacture and install at low cost. The fibre ring 40 is thermally insulating so there is very little heat transfer to the envelope during cathode conditioning, it is also non-magnetic and electrically non-conductive. The support ring 40 does not adversely affect discharge produced by the electrode 30 since this takes place mainly inside the electrode.

The fibre ring 40 may also help reduce or delay damage to the terminal element 35 by filling substances, such as mercury. During assembly, mercury is placed centrally along the length of envelope so its diffusion to the terminal elements at either end will be impeded by the fibre ring. By impeding contact with the mercury, embrittlement of the terminal wires 35 may be reduced.

The support provided by the ceramic fibre ring 40 may enable other forms of support for the electrode 30 to be reduced or removed, thereby reducing the mass of the electrode structure 3 and further reducing the risk of vibration damage.

Various alternative arrangements of support member are possible.

Figure 2:
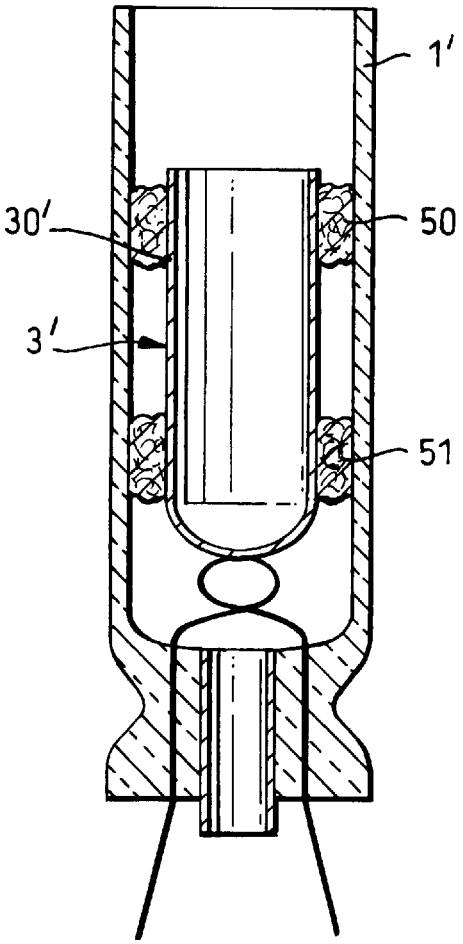
FIGS. 2 and 3 are sectional side elevation views of alternative electrode structures.

With reference now to FIG. 2 there is shown an alternative electrode structure where components equivalent to those in FIG. 1 are given the same reference number with the addition of a prime'. In this arrangement the support member is provided by two separate fibre rings 50 and 51 located between the outside of the electrode 30' and the inside of the envelope 1', the rings being spaced from one another at opposite ends of the electrode. This arrangement provides effective damping of all modes of vibration within the electrode 30' but will have a somewhat greater adverse effect on dielectric coupling and external discharge. The electrode 30' shown in FIG. 2 does not have any surface formation for retaining the fibre rings 50 and 51, although these could be provided.

Figure 3:
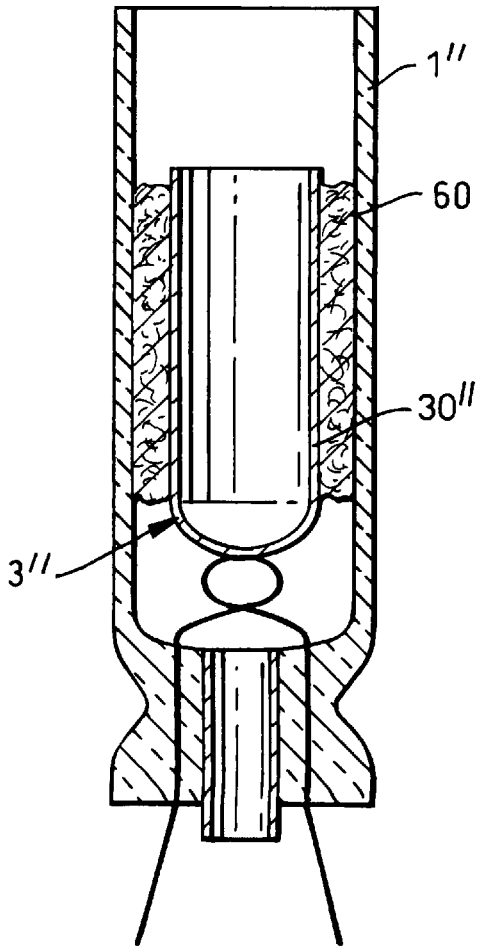

With reference now to FIG. 3 there is shown a further alternative electrode structure where components equivalent to those in FIGS. 1 and 2 are given the same reference number with the addition of a double prime". FIG. 3 shows an arrangement employing a cylindrical sleeve 60 of ceramic fibres extending along the entire length of the electrode 30" compressed between the outside of the electrode and the inside of the envelope 1". Again, this electrode 30" does not have any surface formation for retaining the fibre sleeve 60. This arrangement achieves the greatest support for the electrode 30" and enables thinner terminal elements 35" to be used. It is also a very simple arrangement to assemble, but it has a greater dielectric effect and will restrict gas flow to a greater extent. If the weave of the fibres is sufficiently dense, the support provided by this sleeve 60 can be sufficient by itself to support the electrode 30", without the need for wire terminals 35" to provide any mechanical support. Instead, the thickness of the wires can be reduced to an extent where they are flexible and serve solely to provide electrical connection to the electrode. The use of thinner wires is an advantage because it reduces the occurrence of micro-cracking at the seal with the glass envelope 1". These terminal wires may be attached to the electrode 30" by welding a straight length of wire to the outside of the electrode and forming it into a loop well away from the weld, before it enters the glass of the envelope.

Figure 4:
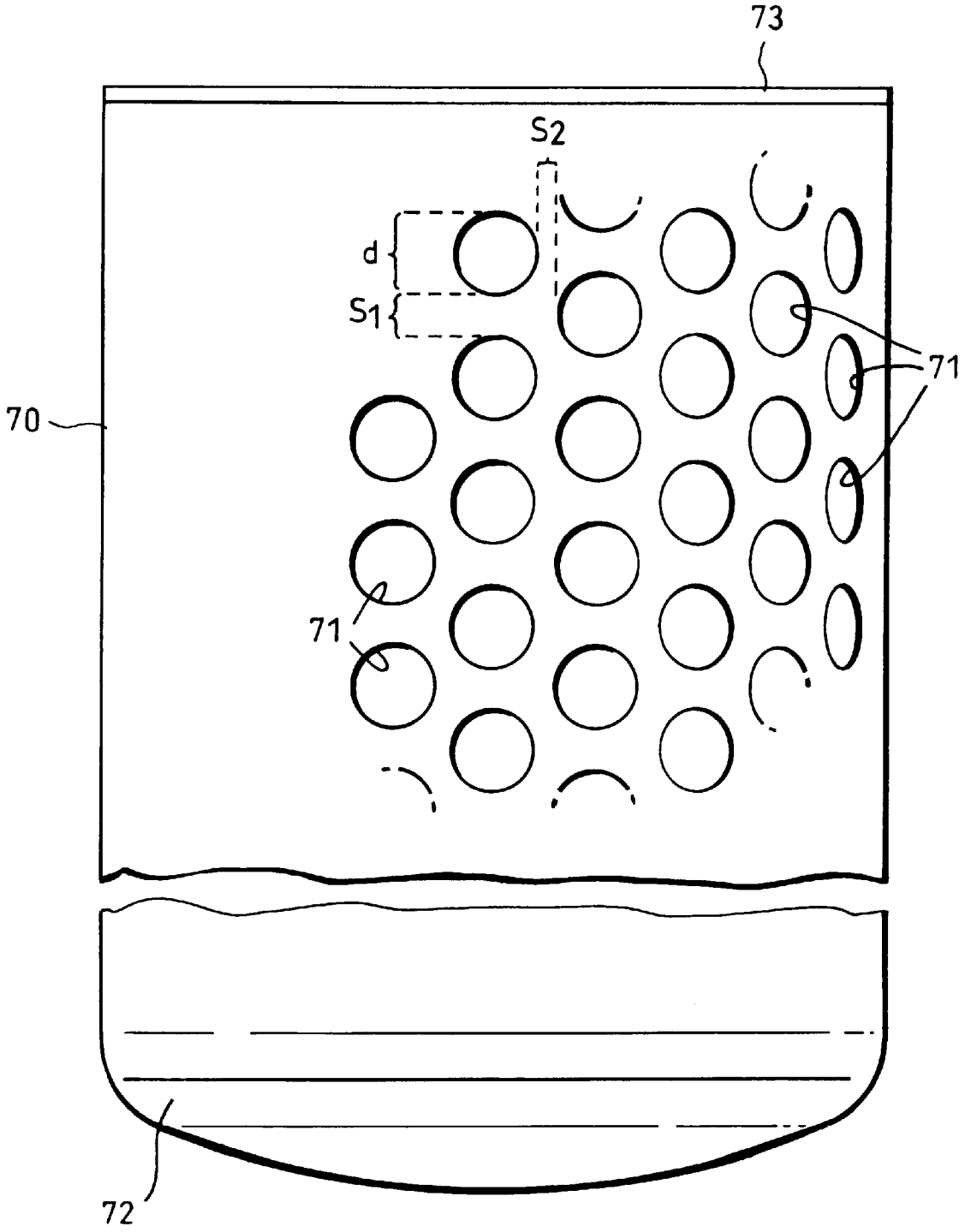
FIG. 4 is a side elevation view of another alternative electrode.

With reference now to FIG. 4, there is shown an electrode 70 that has been modified to reduce its mass. The electrode 70 may have the same shape that shown in FIGS. 1 or 2 and 3, with a solid, cylindrical metal wall but is modified by being perforated with an array of small holes 71 (only some of which are shown) through the wall of the electrode. The holes 71 are of circular shape and may be formed by laser machining while the electrode 70 is mounted in the envelope 1" and before purging. The edge of the holes 71 on the outside of the electrode are preferably rounded to prevent unwanted discharge in this region. This could be achieved by momentarily de-focussing the laser beam. Alternatively, the holes 71 could be formed by any other conventional technique, such as drilling, ion beam erosion, etching or the like. The holes 71 each have a diameter of about 0.3 mm, that is, equal to the wall thickness of the electrode 70, and are located along parallel, longitudinal rows with the holes in one row being located midway between the holes in the rows on opposite sides. The ratio of the diameter "d" of a hole 71 to the spacing "$s_1$" between adjacent holes in the same row is preferably 0.667. The ratio of the spacing "$s_2$" between holes in adjacent rows and the spacing $s_1$ between holes along a row is preferably 0.866. This arrangement reduces the mass of the electrode 70 over the perforated area by 38.8%. The closed end 72 of the electrode 70 is not perforated and the electrode may have an unperforated rim 73 at its open end to increase its strength. This arrangement of perforations does not lead to any reduction in the emissive area on the inside of the electrode 70 because this is compensated for by the additional emissive area gained by the walls of the holes 71. The effective emissive area could be increased over that of a plain hollow cathode by shaping the edge of each hole like a cone.

The electrode structures of the present invention could be used in apparatus other than discharge lamps.

What I claim is:

1. An electrode structure comprising: an outer tubular envelope; a generally tubular electrode extending coaxially within said envelope; an electrical conductor and electrically connected with said electrode and extending out of said envelope; and a support member of annular section, said support member contacting an inner surface of said envelope and an outer surface of said electrode, said support member being of an electrically-insulative, compressible material arranged to damp movement of said electrode relative to said envelope.

2. An electrode structure according to claim 1, wherein said support member is porous.

3. An electrode structure according to claim 1, wherein said support member is of a fiber material.

4. An electrode structure according to claim 3, wherein said support member is of a woven or knitted fiber material.

5. An electrode structure according to claim 3, wherein said support member is of an open looped weave fiber material.

6. An electrode structure according to claim 1, wherein said support member is of a ceramic material.

7. An electrode structure according to claim 6, wherein said ceramic is selected from a group comprising: silica, alumina and zirconia.

8. An electrode structure according to claim 1, wherein said electrode has an outer surface with a surface formation thereon, and wherein said support member is retained on said surface formation.

9. An electrode structure according to claim 8, wherein said surface formation is an annular groove around said electrode.

10. An electrode structure according to claim 1, wherein said support member is retained by an adhesive.

11. An electrode structure according to claim 1, wherein said support member is a single annular ring located at the effective centre of gravity of said electrode structure.

12. An electrode structure according to claim 1, including two of said annular support members spaced from one another along the length of said electrode.

13. An electrode structure according to claim 1, wherein said support member is a tubular sleeve extending substantially along the length of said electrode.

14. An electrode structure comprising: an outer tubular envelope; a generally tubular electrode extending coaxially within said envelope; an electrical conductor electrically connected with said electrode and extending out of said envelope; and an annular support ring of a compressible ceramic fibre material between said electrode and said envelope to damp movement of said electrode relative to said envelope.

15. An electrode structure comprising: an outer tubular envelope; a generally tubular electrode extending coaxially within said envelope; an electrical conductor electrically connected with said electrode and extending out of said envelope; and two annular support rings of a compressible ceramic fibre material spaced apart from one another along the length of said electrode between said electrode and said envelope to damp movement of said electrode relative to said envelope.

16. An electrode structure comprising: an outer tubular envelope; a generally tubular electrode extending coaxially within said envelope; an electrical conductor electrically connected with said electrode and extending out of said envelope; and a tubular sleeve of a compressible ceramic fibre material extending along the length of said electrode between said electrode and said envelope to damp movement of said electrode relative to said envelope.

17. A discharge lamp comprising: an outer tubular, transparent envelope; a generally tubular electrode extending coaxially within said envelope; an electrical conductor electrically connected with said electrode and extending out of said envelope; and a support member of annular section, said support member contacting an inner surface of said envelope and an outer surface of said electrode, said support member being of an electrically-insulative, compressible material arranged to damp movement of said electrode relative to said envelope.

* * * * *